United States Patent [19]

Kalso

[11] 4,188,672

[45] Feb. 19, 1980

[54] MINI-SUPPORT BELT FOR GARMENTS

[76] Inventor: Anne Kalso, 4025 N. 40th St., Phoenix, Ariz. 86018

[21] Appl. No.: 904,163

[22] Filed: May 8, 1978

[51] Int. Cl.[2] ..... A41F 9/02

[52] U.S. Cl. ..... 2/221; 2/237; 128/96

[58] Field of Search ..... 2/221, 237, 76, 220; 128/96, 99

[56] References Cited

U.S. PATENT DOCUMENTS

| | | | |
|---|---|---|---|
| 167,319 | 8/1875 | Eager | 2/237 |
| 464,916 | 12/1891 | Taylor | 2/237 X |
| 1,036,859 | 8/1912 | Kirshen | 2/237 X |
| 1,107,158 | 8/1914 | Day | 2/237 X |
| 1,130,343 | 3/1915 | Seaman | 2/237 X |
| 1,263,225 | 4/1918 | Gear | 2/237 |
| 2,481,396 | 9/1949 | Cohen | 2/237 X |

FOREIGN PATENT DOCUMENTS

| | | | |
|---|---|---|---|
| 115404 | 7/1942 | Australia | 2/237 |

*Primary Examiner*—H. Hampton Hunter

*Attorney, Agent, or Firm*—Lawrence Rosen; E. Janet Berry

[57] ABSTRACT

A mini-support belt for a garment includes first and second sections of non-elastic flexible material. The belt sections are adapted adjacent one end of each for cooperable releasable interconnection. The first and second belt sections, when interconnected, are of sufficient length to extend across the front only of a person's torso below the waist from a location proximate one hip to a corresponding location of the garment relative to the other hip. The invention also includes the combination of a mini-support belt of the character described and a garment adapted to be worn so as to cover at least that portion of the torso extending from the waist downwardly.

12 Claims, 4 Drawing Figures

MINI-SUPPORT BELT FOR GARMENTS

BACKGROUND OF THE INVENTION

The present invention relates to mini-support belts for garments and to garments which incorporate such belts as integral portions thereof.

Support belts for garments have been known heretofore, such belts serving to support the garment upon the wearer in a manner that provides for a smooth fall of the garment about the wearer and accomodation of the wearer's various body movements. Prior belt constructions generally consisted of a band or bands of sufficient length to encompass the waist of the wearer. However, such prior belt constructions were neither intended for nor were capable of providing therapeutic support. Further, although surgical belts have been employed to afford relief where an individual suffered from a hernia condition, it was not previously recognized that a person's stature might be improved through proper control of one's hip. It has been found, for example, that pressure upon the hips can be relieved so that they may adopt a more normal disposition through the constraint of a simple belt device. It has also been found that pressure upon one's diaphragm, perhaps by the removal of tension from the transversus abdominis muscle, may be attenuated through such hip control thereby enabling one to more efficiently utilize the diaphragm and associated breathing apparatus.

SUMMARY OF THE INVENTION

It is, therefore, one object of the invention to provide a mini-support belt adapted to be fitted across the hips of a wearer to constrain the hips into a more normal disposition.

It is another object of the invention to provide a mini-support belt of the character described which can be worn either internally or externally of a garment for the purpose stated.

It is still another object of the invention to provide the combination of a mini-support belt and garment which can be worn to provide desired hip control.

Other objects and advantages of the invention will become readily apparent from the ensuing description of the invention.

In accordance with the invention there is provided a mini-support belt comprising first and second sections of non-elastic flexible material, said first and second sections being adapted adjacent one end of each for cooperable releasable interconnection, the first and second sections, when interconnected, being of sufficient length to extend across the front only of the torso below the waist from a location proximate one hip to a corresponding location relative to the other hip. Although the first and second sections may be of substantially equal lengths, they may also be unequal in length and vary over a wide range.

The invention also provides the combination of a garment and mini-support belt comprising a garment adapted to be worn so as to cover at least that portion of the torso extending downwardly of the waist, and a mini-support belt secured to the garment below the waist portion thereof, said belt being extendable between a location proximate one hip and across the front of the garment to a corresponding location on the other side of the garment, the mini-support belt including first and second belt sections of non-elastic, flexible material; each of said sections having cooperable closure elements for releasably interconnecting the sections.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
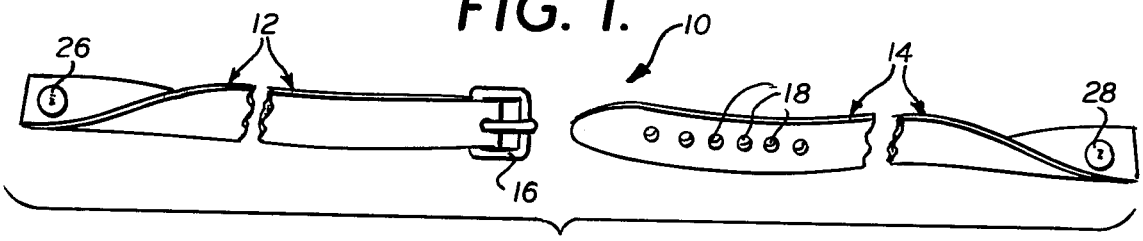
FIG. 1 is a perspective view of mini-support belt embodying the features of the invention.

Referring to the drawings there is shown a mini-support belt 10 which is constructed in first and second sections 12, 14. The belt is fabricated of a non-elastic, flexible material which is desirably, relatively stiff and wrinkle-resistant. Fibrous material such as horsehair, and the like exhibit suitable physical characteristics and may be coverted quite easily into the belt sections. Each of the belt sections are generally of substantially the same length so as to impress equal constraint upon the hips of the wearer in use. The width of the mini-support belt is relatively narrow, i.e. 3 to 10 cm., perferably 5 to 7 cm. If the belt is too narrow, it will not only cut into a person but will not function in accordance with the present invention. The vital place on the hips for the active constraint may vary from person to person, and it may be missed by too narrow a belt. On the other hand, if the belt is too wide it will function only as a corset and undesirably contain the vital organs in the abdominable cavity. One end of each section is provided with one of a pair of cooperable closure elements 16, 18 capable of coacting to releasably interconnect the sections when the belt is worn and tightened into its operative disposition. Suitable closure elements may be the conventional buckle, snaps or the like. As will be understood, whichsoever closure means is selected provision is made for a plurality of settings to accomodate a range of hip measurements so that the desired constraint upon the hips can be developed.

Figure 4:
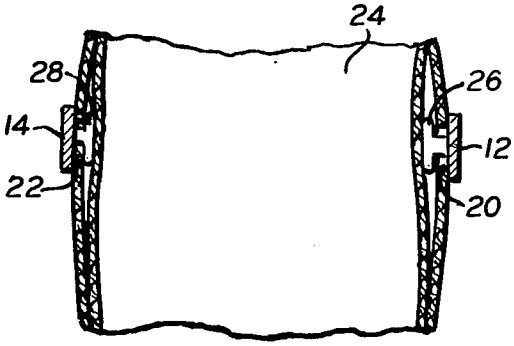
FIG. 4 is a perspective view showing the end portion of a belt constructed in accordance with the invention and means by which it may be secured to the garment together with a portion of the garment and showing cooperable means thereon for receiving the end of the belt.

Referring to FIG. 4 it will be observed that the other ends of the belt sections are preferably given fastening means such as buttons, loops or the like which are cooperable with mating fastening elements on the sides of the garments in order that such ends may be secured to a garment 24 to thereby anchor the belt sections in position and transmit the tightening force to the hips without undue distortion of the rear of the garment. As depicted in FIG. 4 cooperable elements 26, 28 in the form of buttons are carried by the belt sections for cooperation with button hole elements 20, 22 on the garment. It will be understood of course, that such other ends of the belt sections may be sewn onto the garment to affix the belt sections securely thereto.

Figure 2:
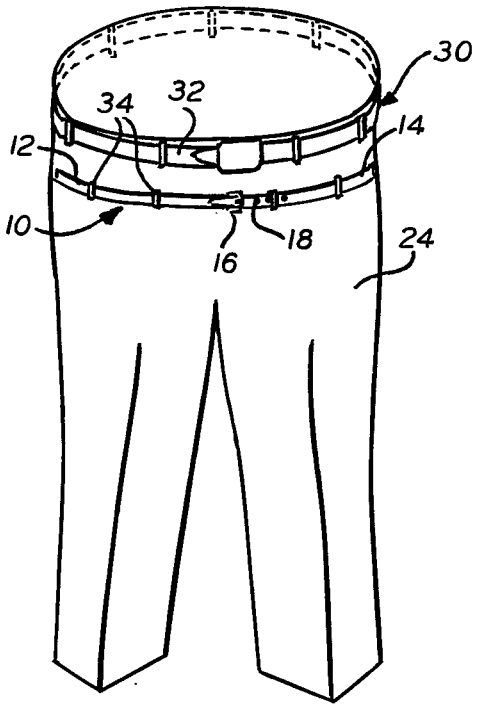
FIG. 2 is a perspective view of a garment to which the mini-support belt shown in FIG. 1 has been secured.
Figure 3:
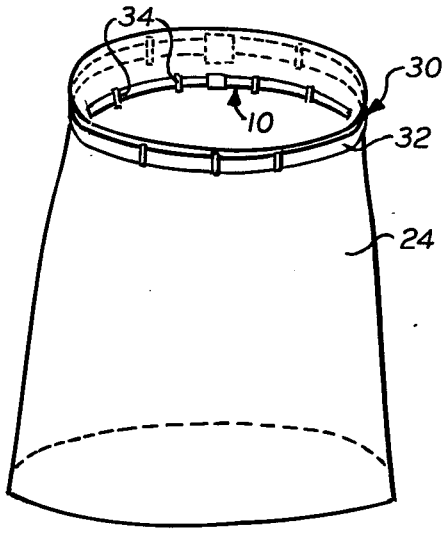
FIG. 3 is a view similar to that of FIG. 2 except that the belt has been secured internally of the garment.

It will be seen from FIGS. 2 and 3 that the belt, when the sections thereof are interconnected, is of sufficient length to extend only across the front of the garment, the tightening force created in the front being thus converted into a constraining force at each hip of the wearer. It will also be noted that the belt is adapted to be worn below the waistline 30 of the garment unlike belt constructions of the prior art. It is not contemplated that the belt of the invention will replace the conventional waistline belt 32 illustrated in FIGS. 2 and 3 since it is employed for an entirely different purpose.

The garment is desirably provided with a plurality of loop elements 34 affixed thereto and dimensioned to permit the insertion of the belt sections therethrough. Such belt loops may be provided either interiorly or exteriorly of the garment depending, of course, upon where the belt of the invention is to be worn.

The belt of the invention may be constructed as shown in FIG. 4 so that it may be removed from the garment when desired or it may be incorporated in the garment construction in which event the end of each belt section remote from the free ends to be interconnected with the other section may be stitched to the garment. If desired substantially the entire belt may be stitched to the garment except for a relatively short length adjacent the ends to be interconnected. It will, of course, be appreciated that other techniques for securing the belt sections to the garment may be employed such, for example, as cooperable snap elements, Velcro elements, etc.

The belt of the invention may be utilized with slacks, skirts or other garments which are designed to be worn by a person so as to cover at least that portion of the torso extending downwardly of the waist. Although the belt sections need only be of sufficient length such that when interconnected they extend between the opposed hips of the wearer it is within the contemplation of the invention to construct the belt sections so that they may be secured to the garment from a location slightly to the rear of each hip bone. The important feature of the invention is that when secured to the garment it will be possible to convert the tightening force at the front of the belt into an adequate constraining force at each hip bone to relieve the rearward pressure on the hips.

Although the invention has been described in specific terms it will be understood that various changes may be made in size, shape, materials and in the arrangement of the components without departing from the spirit and scope of the invention as claimed.

What is claimed is:

1. A mini-support belt having a width of from about 3 to 10 cm. for a garment comprising first and second sections formed of non-elastic flexible material, each of said sections having at one end thereof one of a pair of cooperable closure elements adapted to releasably interconnect said first and second sections, said first and second sections, when interconnected, being of sufficient length to extend across the front only of a person's torso below the waist from a location in substantial alignment with one hip to a corresponding location on the other hip whereby the tightening force at the front of the belt is converted into a constraining force at each hip bone to relieve rearward pressure on the hips.

2. A mini-support belt according to claim 1 fabricated from a wrinkle-resistant relatively stiff fibrous material.

3. A mini-support belt according to claim 1, wherein the other ends of said belt sections are provided with fastening means cooperable with mating elements carried by a garment.

4. A mini-support belt according to claim 3, wherein said fastening means comprise buttons.

5. A mini-support belt according to claim 3, wherein said fastening means comprise loop elements.

6. The combination of garment and mini-support belt comprising:

a garment adapted to be worn so as to cover at least that portion of the torso extending from the waist downwardly thereof;

a mini-support belt having a width of from about 3 to 10 cm. secured to said garment below the waist portion of the garment and extendable between a location in substantial alignment with one hip of the wearer across the front of the garment to a corresponding location on the other side of the garment whereby the tightening force at the front of the belt is converted into a constraining force at each hip bone to relieve rearward pressure on the hips;

said mini-support belt including first and second sections formed of non-elastic flexible material, said sections being provided each at one end thereof with one of a pair of cooperable closure elements adapted to releasably interconnect said belt sections.

7. The combination of claim 6, wherein said belt sections are fabricated of a wrinkle-resistant relatively stiff fibrous material.

8. The combination of claim 6, wherein at least the other end of said first and second belt sections are stitched to the inner surface of the garment.

9. The combination of claim 6, wherein said belt is secured to the inner surface of said garment.

10. The combination of claim 6, including a plurality of loop elements affixed to said garment below the waist portion thereof and are adapted to support said belt therein.

11. The combination of claim 10, wherein said loop elements are affixed to the exterior of said garment.

12. The combination of claim 5, wherein said first and second belt sections have substantially equal lengths.

* * * * *